United States Patent [19]

Kasamatsu et al.

[11] Patent Number: 4,759,281

[45] Date of Patent: Jul. 26, 1988

[54] APPARATUS FOR PRESSING STACK OF SIGNATURES

[75] Inventors: Tamotsu Kasamatsu, Osaka; Koh Yatsuka, Amagasaki, both of Japan

[73] Assignee: Shin Osaka Zoki Co., Ltd., Osaka, Japan

[21] Appl. No.: 25,531

[22] Filed: Mar. 13, 1987

[51] Int. Cl.[4] ..... B30B 15/16

[52] U.S. Cl. ..... 100/295; 100/233; 100/244; 100/236

[58] Field of Search ..... 100/295, 269 R, 233, 100/93, 3, 236

[56] References Cited

U.S. PATENT DOCUMENTS 4,140,052 2/1979 Meier ..... 100/295

FOREIGN PATENT DOCUMENTS 59-115211 7/1984 Japan .
59-128159 7/1984 Japan .

*Primary Examiner*—Ronald Feldbaum

[57] ABSTRACT

This invention provides an apparatus for pressing a stack of signatures including a first pressing member mounted on a bracket upwardly and downwardly movable by drive means for pressing the stack of signatures over an intermediate upper surface area thereof, a pivotally movable second pressing member connected at its one end to each end of the first pressing member for pressing the signature stack over the remaining upper surface area at each end thereof, an arm for pivotally moving the second pressing member and air cylinder-plunger means for driving the arm, the apparatus being characterized in that the cylinder-plunger means is disposed above the first pressing member and attached to the bracket, the plunger of the cylinder-plunger means being directed downward and having a lateral support member, the arm having one end pivoted to the support member and the other end to a base portion of the second pressing member.

4 Claims, 3 Drawing Sheets

APPARATUS FOR PRESSING STACK OF SIGNATURES

The present invention relates to an apparatus for pressing a stack of signatures (folded sheets), and more particularly to an apparatus for pressing a stack of many signatures or folded sheets from above to a reduced height when the stack is bound with a band or the like.

Conventional apparatus for pressing a stack of signatures are adapted to press the stack over the entire upper surface thereof with a pressing plate. The apparatus of this type is unable to press the stack to a full extent since air is not smoothly driven out from between the signatures on pressing.

The present applicant has already proposed an improved apparatus for pressing stacked signatures as disclosed in Unexamined Japanese Patent Publication No. SHO 59-128159. FIG. 3 attached hereto shows the main assembly of this apparatus. The apparatus includes air cylinder-plunger means 100, 100 connected together back to back and each having a laterally projecting plunger 101. A first pressing member 102 is disposed below these means 100, 100 and attached to a bracket (not shown) which is movable upward and downward by another air cylinder-plunger means (not shown). Second pressing members 103, 103 are pivoted to the opposite ends of the pressing member 102 with pins 104, 104. Each of levers 105, 105 has one end pivoted to the second pressing member 103 by a pin 106 and the other end pivoted to a support member 107 by a pin 108. An intermediate portion of the lever 105 is connected to the plunger 101 of the air cylinder-plunger means 100. The support member 107 is attached to the above-mentioned bracket. The first pressing member 102 has such a width as to extend over an intermediate upper surface area of a stack a of signatures, while the second pressing member 103 has such a width as to extend over the remaining surface area of the stack a at each end thereof.

The proposed apparatus operates in the following manner. First, the first pressing member 102 is depressed against the stack a to press the stack a over the intermediate area. With the stack a thus pressed, the plungers 101, 101 are operated, causing the levers 105, 105 to pivotally move the second pressing members 103, 103 from the solid-line position to the chain-line position shown in FIG. 3, whereby the stack a is pressed over the end areas.

As is well known to those skilled in the art, the stack a of signatures is made up of a suitable number of signature substacks a-1 which are stacked up with the fold side of signatures of the substacks positioned alternately at opposite sides of the stack a to assure stacking with good stability.

In the case of the proposed apparatus, the signature stack is pressed first by the first pressing member over the intermediate area and subsequently by the second pressing members over the end areas as described above, so that the stack can be compressed effectively with air released from the stack also effectively.

Nevertheless, it has been found that the above apparatus has the following problem.

The stack a, when composed of an odd number of substacks a-1, has a slanting upper surface due to the difference in number between the substacks oriented in one direction and those oriented in the other direction. On the other hand, for each of the second pressing members 103, 103 to move pivotally as stated above, the pin 106 must perform a circular motion about the pin 104 in a vertical plane. Consequently, the point of connection between the lever 105 and the plunger 101 is upwardly displaced by the pivotal movement of the second pressing member 103 although the displacement is small. It therefore follows that the air cylinder-plunger means 100, 100 must be mounted on their support (not shown) slightly movably upward and downward relative to the first pressing member 102. This results in a tendency for the second pressing members 103, 103 to incline along the slanting upper surface of the signature stack a when pressing the stack a. Thus, for the proposed apparatus to press the stack with a satisfactory result, the stack must be composed of an even number of substacks a-1.

The main object of the present invention is to provide an apparatus for pressing a stack of signatures without the foregoing problem.

This object is fulfilled by an apparatus defined in claim 1. Preferred improvements of this apparatus are subject of the subclaims.

The present invention provides an apparatus which includes a first pressing member mounted on a bracket upwardly and downwardly movable by drive means for pressing a stack of signatures over an intermediate upper surface area thereof, a pivotally movable second pressing member connected at its one end to each end of the first pressing member for pressing the signature stack over the remaining upper surface area at each end thereof, an arm for pivotally moving the second pressing member and air cylinder-plunger means for driving the arm, the apparatus being characterized in that the cylinder-plunger means is disposed above the first pressing member and attached to the bracket, the plunger of the cylinder-plunger means being directed downward and having a lateral support member, the arm having one end pivoted to the support member and the other end pivoted to a base end portion of the second pressing member.

According to the present invention, the first pressing member and the second pressing member are each used for a purpose similar to that of the corresponding member of the proposed apparatus described above.

With the present invention, the lateral support member, when depressed by the plunger of the air cylinder-plunger means, causes the arm to move the second pressing member. For this movement of the second pressing member, the cylinder-plunger means, unlike the one included in the proposed apparatus, need not be shifted upward relative to the first pressing member, because the plunger of the cylinder-plunger means of the invention is directed downward and is therefore movable upward and downward. With this arrangement, the pivot (corresponding to the pin 106 of the proposed apparatus) of the second pressing member on the arm performs in a vertical plane a circular motion, which is absorbed by the inclination of the arm due to the circular motion. According to the present invention, therefore, the air cylinder-plunger means can be fixed to the bracket unlike the corresponding means of the proposed apparatus. This obviates the likelihood that the second pressing member will incline when pressing a stack composed of an odd number of signature substacks.

The above and other features of the present invention will be described below in detail with reference to the accompanying drawings, in which.

Figure 1:
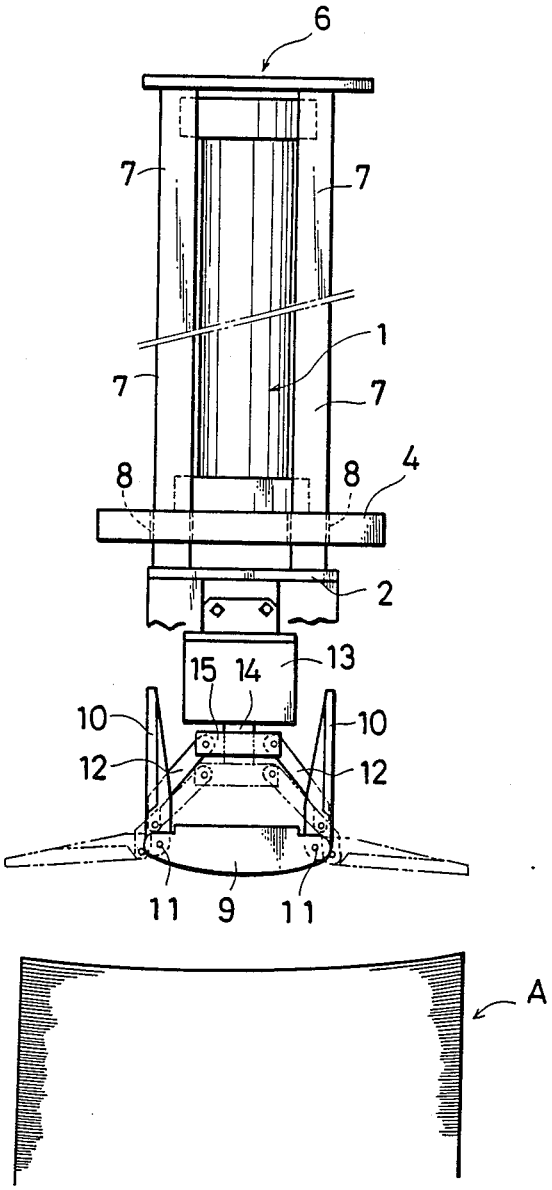
FIG. 1 is a front view showing an embodiment of the invention.
Figure 2:
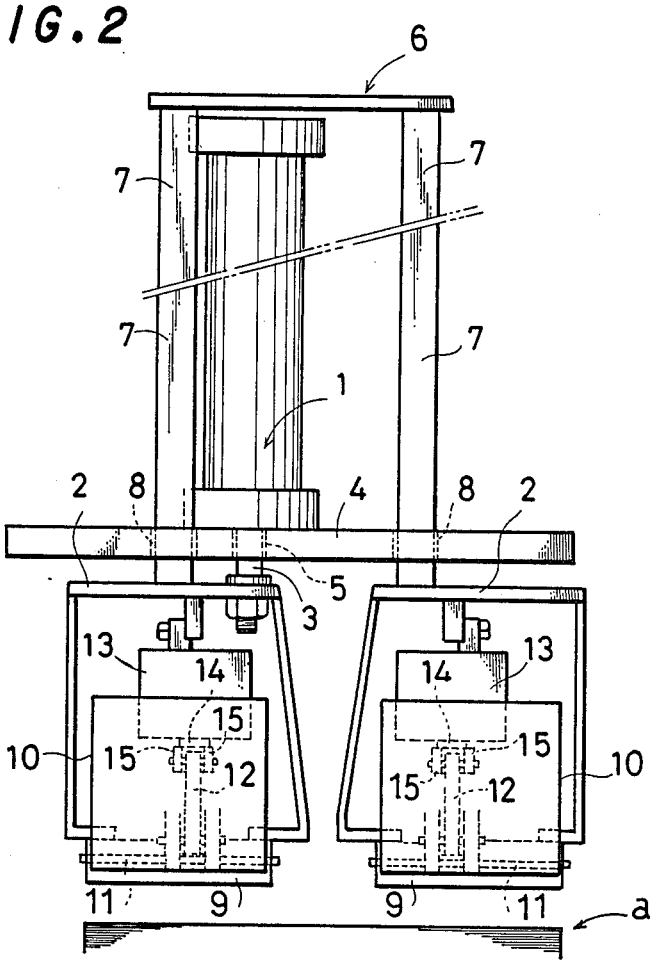
FIG. 2 is a side elevation of the same.
Figure 3:
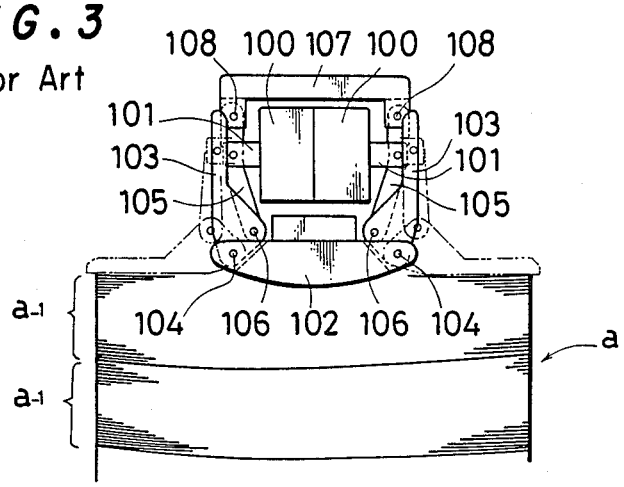
FIG. 3 Prior Art
FIG. 3 shows the prior art device.

The apparatus shown in FIGS. 1 and 2 includes brackets 2, 2 which are movable upward and downward by drive means, for example, by air cylinder-plunger means 1. The cylinder-plunger means 1 has a plunger 3 extending downward through a hole 5 in a plate 4 providing a portion of the main frame of the apparatus and is connected to one of the brackets 2. The apparatus further has a frame assembly 6 including columns 7, 7. These columns 7, 7 extend downward through holes 8, 8 in the plate 4 and are connected to the brackets 2, 2, respectively.

The brackets 2, 2 have attached to their lower ends first pressing members 9, 9, respectively, for pressing a stack A of signatures over an intermediate upper surface area thereof. Second pressing members 10, 10 are pivoted, each at its one end by a pin 11, to the opposite ends of each of the first pressing members 9, 9 in order to press the stack A over the remaining upper surface areas at the opposite ends of the stack. An arm 12 for pivotally moving each second pressing member 10 about the pin 11 is pivoted at one end thereof to a base end portion of the second pressing member 10. An air cylinder-plunger means 13 for driving the arms 12, 12 for each pair of second pressing members 10, 10 is disposed above the first pressing member 9 and attached to the bracket 2. The cylinder-plunger means 13 has a plunger 14 directed downward and having lateral support members 15, 15. The other end of each arm 12 is pivoted to the corresponding ends of the support members 15, 15.

The apparatus of FIGS. 1 and 2 operates in the following manner. When the brackets 2, 2 are driven downward by the plunger 3 of the air cylinder-plunger means 1, the first pressing members 9, 9 are depressed against the signature stack A to press the intermediate area of the stack A. With the stack A thus pressed, the support members 14, 14 is depressed by the plunger 14 of each air cylinder-plunger means 13, whereby the members 15, 15 cause the arms 12, 12 to pivotally move the second pressing members 10, 10 downward to press the end areas of the stack A.

While being pressed in this way, the stack A is bound with a band or the like in the usual manner at a suitable portion thereof, for example, the portion of the stack opposed to the space between the juxtaposed brackets 2,2.

After completion of the binding, the operating members are reset to the initial state.

We claim:

1. An apparatus for pressing a stack of signatures including a first pressing member mounted on a bracket upwardly and downwardly movable by drive means for pressing the stack of signatures over an intermediate upper surface area thereof, a pivotally movable second pressing member connected at its one end to each end of the first pressing member for pressing the signature stack over the remaining upper surface area at each end thereof, an arm for pivotally moving the second pressing member and air cylinder-plunger means for driving the arm, the apparatus being characterized in that the cylinder-plunger means is disposed above the first pressing member and attached to the bracket, the plunger of the cylinder-plunger means being directed downward and having a lateral support member, the arm having one end pivoted to the support member and the other end pivoted to a base end portion of the second pressing member.

2. An apparatus as defined in claim 1 which comprises two assemblies arranged side by side and each comprising the bracket, the first pressing member, the second pressing member, the arm and the air cylinder-plunger means for driving the arm.

3. An apparatus as defined in claim 2 wherein the brackets of the assemblies arranged side by side are connected together by a frame assembly.

4. An apparatus as defined in any one of claims 1 to 3 wherein the drive means for moving the bracket upward and downward comprises air cylinder-plunger means.

* * * * *